United States Patent [19]

Harper et al.

[11] 3,986,036

[45] Oct. 12, 1976

[54] SELECTIVE SHIELDING DEVICE FOR SCINTIPHOTOGRAPHY

[76] Inventors: John W. Harper, 3623 Bob Billa, San Antonio, Tex. 78223; Thomas D. Kay, 2814 Knight Robin, San Antonio, Tex. 78209

[22] Filed: May 19, 1975

[21] Appl. No.: 578,848

[52] U.S. Cl. ..... 250/515; 250/519

[51] Int. Cl.[2] ..... G21F 1/00; G21F 3/00

[58] Field of Search ..... 250/515, 516, 519, 520, 250/510

[56] References Cited

UNITED STATES PATENTS

| | | | |
|---|---|---|---|
| 2,794,128 | 5/1957 | Shasky | 250/519 |
| 3,039,001 | 6/1962 | Park et al. | 250/519 |
| 3,233,248 | 2/1966 | Bushnell | 250/516 |

*Primary Examiner*—Archie R. Borchelt
*Attorney, Agent, or Firm*—Joseph E. Rusz; Jacob N. Erlich

[57] ABSTRACT

A selective shielding device to be used in combination with a scintillation camera. The shielding device being of a substantially oval-shaped configuration and removably secured to the scintillation camera. As a result of this combination scanning of preselected areas of a patient can be rapidly and accurately performed without the requirement of mounting any type of shielding paraphernalia on the patient.

1 Claim, 2 Drawing Figures

SELECTIVE SHIELDING DEVICE FOR SCINTIPHOTOGRAPHY

STATEMENT OF GOVERNMENT INTEREST

The invention described herein may be manufactured and used by or for the Government for governmental purposes without the payment of any royalty thereon.

BACKGROUND OF THE INVENTION

This invention relates generally to scintiphotography, and, more particularly, to a shielding device which is used with the Gamma Scintillation Camera during scintiphotography.

Scintiphotography is the diagnostic technique by which both normal and diseased organs within a patient can be studied by following the passage of radioisotopes through the organ. This procedure is performed by the use of a Gamma Scintillation Camera such as Nuclear Chicago's Pho/Gamma HP camera which has the ability to visualize the entire organ of interest at one time and to follow the passage of radioisotopes through the organ. Radiation from the radioisotope is rapidly detected and the position and intensity or the gamma events are produced and displayed in a corresponding position on a cathode ray tube display. Time exposures of the gamma image can be taken thereby providing studies of the organ function in both normal and diseased states. A choice of collimators for various resolution and sensitivity requirements help assure meaningful recordings for most clinical situations.

The Gamma Scintillation Camera System is made up of a gamma detector, assembly for supporting the detector and drive motors and controls for detector orientation. Within the gamma detector is a sodium-iodide thallium activated scintillation crystal. The control console is a desk type assembly which contains an XYZ Analyser, timer, display and power supply.

Heretofore, during the scintiphotography procedure when it became necessary to scan a selective segment of a patient's anatomy, especially in the area about the vascular areas, the patient was required to wear a specifically designed shielding device or protective covering. Not only did such a device prove to be cumbersome and uncomfortable to the patient, this device also has to be manufactured in a wide variety of shapes and/or sizes to meet the scintiphotography and patient requirements. As a result thereof, many repeat scans were necessary before a positive diagnosis became possible. Such repeat procedures, therefore, became time consuming as well as expensive to both the patient and the physician.

SUMMARY OF THE INVENTION

The instant invention sets forth a shielding device for scintiphotography with a Gamma Scintillation Camera which overcomes the problems set forth in detail hereinabove.

The selective shielding device of this invention is utilized in combination with a typical Gamma Scintillation Camera in order to eliminate all scatter radiation from, for example, the vascular areas (nose, mouth and sinus area) of a patient's anatomy. It is possible with the shielding device of this invention to perform a scanning operation wherein the patient is not required to wear any special paraphernalia.

The shielding device of the instant invention is made of a single piece of vinyl coated lead material which is removably secured to a Gamma Scintillation Camera. The shield is of an oval-shaped configuration having an extended tip on one side thereof to allow for the nasal area of a patient in the anterior anatomical position. A tab is located at each end of the shield and opposite the extended tip for attachment to the Scintillation Camera. This attaching means is of the type which makes rapid re-positioning possible and also enables the shield to be rearranged on the camera for numerous anatomical views.

It is therefore an object of this invention to provide a selective shielding device for scintiphotography which is capable of eliminating all scatter radiation during the scanning procedure without requiring the patient to wear the device.

It is another object of this invention to provide a selective shielding device for scintiphotography which allows for the production of clear scintiphotos with great statistical value in a relatively short period of time.

It is a further object of this invention to provide a selective shielding device for scintiphotography which can be rapidly repositioned on a Scintiphotography Camera thereby enabling numerous anatomical views to be taken.

It is still another object of this invention to provide a selective shielding device for scintiphotography which is economical to produce and which utilizes conventional, currently available components that lend themselves to standard mass producing manufacturing techniques.

For a better understanding of the present invention together with other and further objects thereof reference is made to the following description taken in conjunction with the accompanying drawing and its scope will be pointed out in the appended claims.

DETAILED DESCRIPTION OF THE PREFERRED EMBODIMENT

Figure 1:
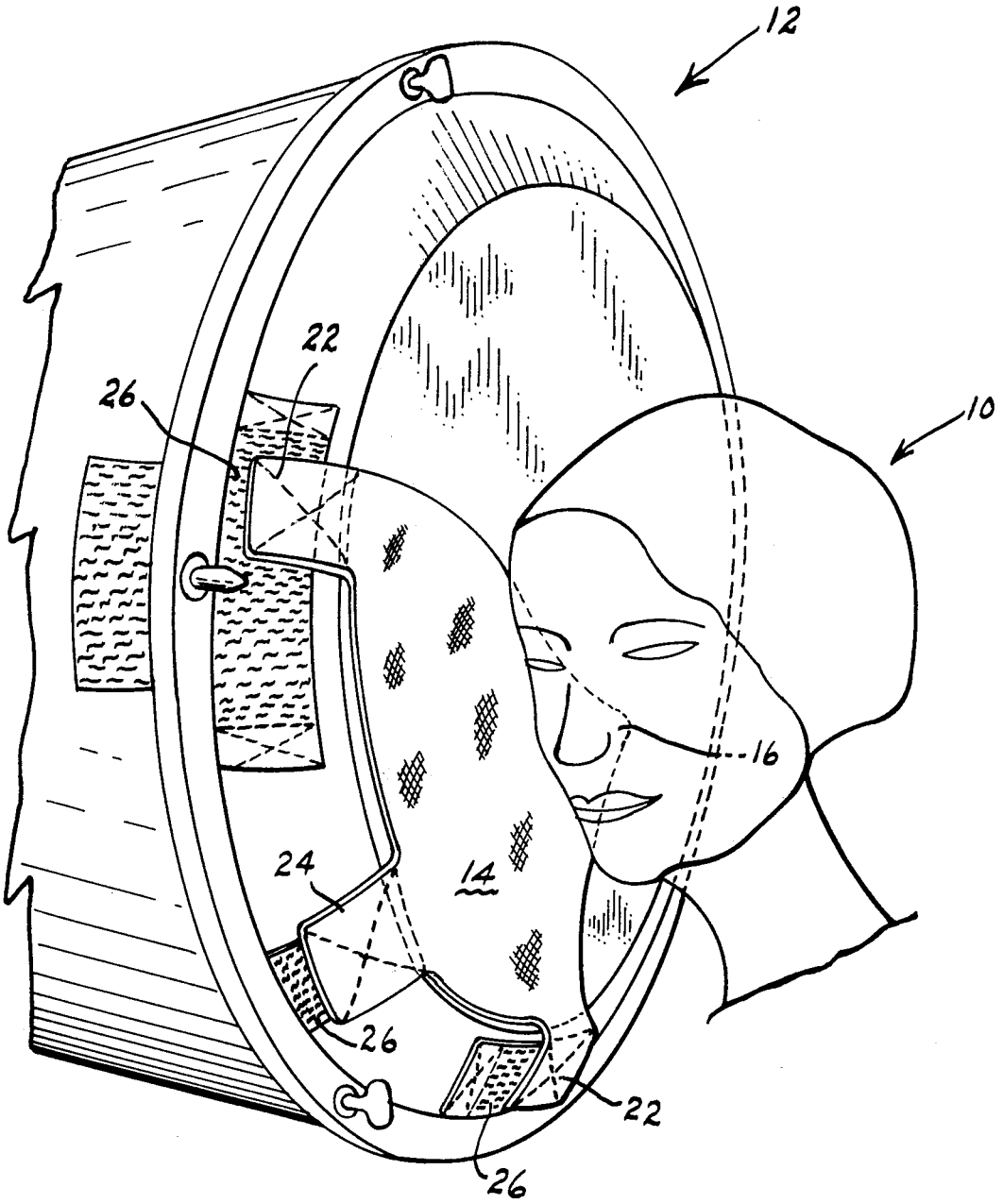
FIG. 1 is a pictorial representation of the selective shielding device of this invention mounted on and forming a combination with a Scintiphotography Camera.

Reference is now made to FIG. 1 of the drawing which shows in pictorial fashion the head 10 of a patient situated in front of a conventional Gamma Scintillation Camera 12 during the scintiphotography operation with the selective shielding device 14 of this invention held in position of camera 12.

Figure 2:
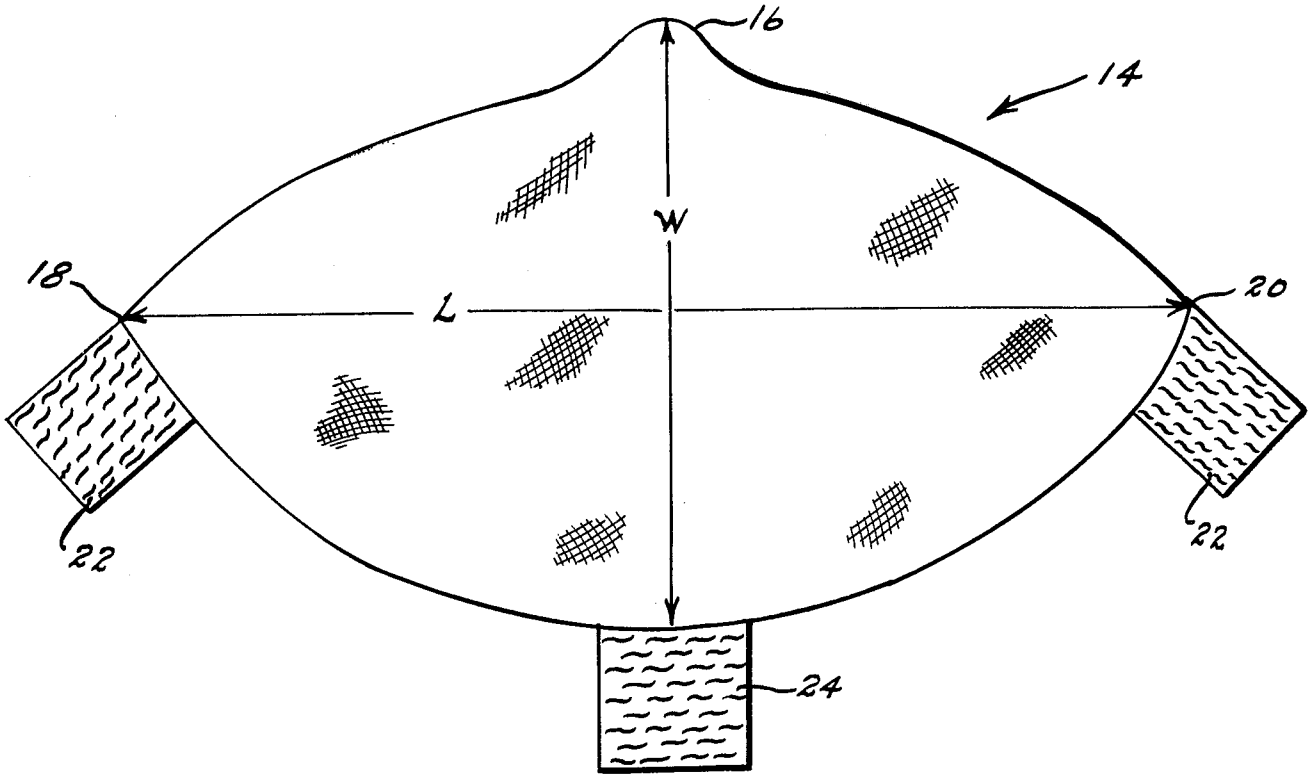
FIG. 2 is a plan view of the selective shielding device for scintiphotography of this invention.

The use of shielding device 14 of this invention eliminates the need for any protective paraphernalia to be mounted upon patient 10. As shown in FIGS. 1 and 2 of the drawing, shielding device 14 has a substantially oval configuration. The elongated dimension of length, L, is approximately 13½ inches and the shorter dimension or width, W, is approximately 7 inches. Also included in the oval configuration of shield 14 is a convexly shaped tip 16 formed along the width thereof to allow for the nasal area of a patient 10 in the anterior anatomical position. Shield 14 is constructed of any suitable shielding material such as vinyl coated lead approximately ⅛ inch thick.

Located on opposite ends 18 and 20 of shield 14 are a pair of securing elements or tabs 22. A similar tab 24 is located directly opposite the extended tip 16. A plurality of mating fasteners 26 are secured at various points along the head of camera 12 for proper positioning of the selective shielding device 14 of this invention. Any suitable securing elements or fasteners 22, 24 and 26 of the type capable of rapid adherence to and removal from one another in a plurality of positions may be used with the instant invention.

The utilization of the specifically designed shielding device 14 in combination with a conventional scintillation camera 12 in the manner shown in FIG. 1 allows for the rapid positioning and removal of shielding device 14 as well as for the comfortable positioning of a patient during the scintiphotography procedure without any cumbersome shielding devices being placed directly upon patient 10. Shield 14, thereby successfully blocks out all radiation coming from below the orbit area in the anterior view and therefore makes the resultant scan much clearer. A physician can therefore make a rapid, accurate diagnosis of the scan.

Although this invention has been described with reference to a particular embodiment it will be understood to those skilled in the art that this invention is also capable of a variety of alternate embodiments within the spirit and scope of the appended claims.

We claim:

1. The combination of a selective shielding device and a scintillation camera comprising three fastening elements secured in preselected locations on said camera, said shielding device being formed of a substantially oval shaped body having a predetermined length and a width substantially one half the size of said predetermined length, said body having a convex-shaped tip extending in the direction of said width of said body on the periphery of one side of said body, a pair of fastening elements secured to opposite sides of said body lying substantially along the length thereof, a third fastening element secured to said body lying substantially along the width thereof on a side of said body opposite said convex-shaped tip, said fastening elements on said camera and said fastening elements on said shielding device being capable of rapidly and adjustably mounting said shielding device to said camera at preselected locations thereon and said body of said shielding device being made of a vinyl coated lead material capable of blocking any radiation emitted by said camera, whereby the head of a patient located adjacent said camera and having a preselected area of said head positioned in front of said shielding device is prevented from receiving any radiation upon said preselected area.

* * * * *